US008617679B2

(12) United States Patent
Kreger

(10) Patent No.: US 8,617,679 B2
(45) Date of Patent: Dec. 31, 2013

(54) LARGE-VOLUME PACKING CONTAINER FOR BITUMEN

(75) Inventor: Michael Kreger, Berndorf (AT)

(73) Assignee: Bitumen Applied Research Limited, Valletta (MT)

( * ) Notice: Subject to any disclaimer, the term of this patent is extended or adjusted under 35 U.S.C. 154(b) by 628 days.

(21) Appl. No.: 12/733,963

(22) PCT Filed: Sep. 30, 2008

(86) PCT No.: PCT/AT2008/000350

§ 371 (c)(1),
(2), (4) Date: Mar. 31, 2010

(87) PCT Pub. No.: WO2009/043071

PCT Pub. Date: Apr. 9, 2009

(65) Prior Publication Data

US 2010/0252476 A1 Oct. 7, 2010

(30) Foreign Application Priority Data

Oct. 2, 2007 (AT) ..... A 1555/2007

(51) Int. Cl.

| | |
|---|---|
| ***B32B 1/08*** | (2006.01) |
| ***B65D 30/00*** | (2006.01) |
| ***B65D 30/04*** | (2006.01) |
| ***B65D 30/10*** | (2006.01) |

(52) U.S. Cl.

USPC ..... 428/36.1; 383/117; 383/118; 383/120; 383/907

(58) Field of Classification Search

USPC ..... 428/36.1; 383/107, 112, 116–120, 907
See application file for complete search history.

(56) References Cited

U.S. PATENT DOCUMENTS

| | | | | |
|---|---|---|---|---|
| 2,507,939 | A | 5/1950 | Smith | |
| 2,638,951 | A | 5/1953 | Smith et al. | |
| 2,674,287 | A | 4/1954 | Smith et al. | |
| 5,024,344 | A * | 6/1991 | Paula | 220/9.3 |
| 5,287,903 | A * | 2/1994 | Ambasz | 150/129 |
| 6,394,651 | B2 * | 5/2002 | Jackson | 383/75 |
| 2008/0296195 | A1 * | 12/2008 | Suarez | 206/524.1 |

FOREIGN PATENT DOCUMENTS

| | | | |
|---|---|---|---|
| AT | 009 644 | U1 | 1/2008 |
| DE | 8421154 | U1 | 10/1984 |
| EP | 0 017 394 | A2 | 10/1980 |
| FR | 2 675 784 | A1 | 10/1992 |
| NL | 8401274 | | 11/1985 |

* cited by examiner

*Primary Examiner* — Jenna Johnson
(74) *Attorney, Agent, or Firm* — Chapman and Cutler LLP

(57) ABSTRACT

The invention relates to a large-volume packing container for bitumen, the container being made of flexible material and having approximately a truncated pyramid-like basic shape prior to filling, wherein the container is closed at the top by a cover wall (6) extending parallel to the bottom surface and having a preferably central filling opening (10). In order to achieve self-stabilization during filling, or stability during storage, in the temperature range from 100° to 110° C. the woven fabric forming the walls (1, 2, 3, 4, 5, 6) has a stretching capacity of 10-25%, preferably 15-20%, in the direction of the warp and weft, wherein stabilizing means (14), such as pleats, seams, strips or the like are drawn or sewn into the lower region of the fabric panels forming the lateral walls (1, 2, 3, 4) in order to stabilize the woven fabric to forces occurring obliquely to the warp and weft.

12 Claims, 1 Drawing Sheet

LARGE-VOLUME PACKING CONTAINER FOR BITUMEN

The invention relates to a large-volume packing container for bitumen, the container being made of flexible material and having approximately a truncated pyramid-like basic shape prior to filling, wherein the container is closed at the top by a cover wall extending parallel to the bottom surface and having a preferably central filling opening.

From U.S. Pat. Nos. 2,507,939 A, 2,674,287 A and 2,638,951 A packing containers of this type have become known, whereby in these known embodiments foldable, portable water tanks are concerned, which are intended for the transport of greater amounts of water or other liquids. Hereby solely packing containers for liquids are concerned.

Bitumen as charge is more difficult to handle insofar as it is a melt, which is liquid to viscous at higher temperatures and sets at lower temperatures. Solidified melts have the property, that even at low temperatures they are not completely rigid. Although bitumen exhibits strong cohesion at ambient temperature, it has a very low internal friction, such that it behaves as a very slow running mass when cooled. If bitumen is filled in a container that is not dimensionally stable, the bitumen dodges during transport or storage due to the plastic flow (slow flow), which complicates stacking of such containers or makes it impossible. Therefore bitumen is stored in barrels or as small packs in cartons or plastic foil, which as such are dimensionally stable containers.

The object of the invention is to create a large-volume packing container of the initially mentioned kind, which is self-stabilising during filling of the bitumen and even when the bitumen stiffened, under stress from above, stands freely.

According to the invention this object is solved in that in the temperature range from 100° to 110° C. the woven fabric forming the walls has a stretching capacity of 10-25%, preferably 15-20%, in the direction of the warp and weft, wherein stabilising means, such as pleats, seams, strips or the like are drawn or sewn into the lower region of the fabric panels forming the lateral walls in order to stabilize the woven fabric to forces occurring obliquely to the warp and weft. Thus the fabric forming the walls can stretch within predetermined limits due to the temperature of the filled bitumen, which leads to a certain bulging of the container. So that the bulge is not too prominent and as well so that no sideways creeping of the container takes place the stabilising means are inserted in the fabric panels forming the lateral walls. The stability or the prevention of unguided bulging of the container is insofar important, as such containers are loaded in so-called "ISO-Container". These "ISO-Container" are internationally also called "TEU", which stands for "Twenty Feet Equivalent Unit". In these freight containers two packing containers are each put on the floor next to each other and subsequently two further containers are stacked on top of these two packing containers. It has to be avoided, that due to a strong bulging of the containers these are wedged or jammed in the freight container, which could make the unloading of the containers from the freight container difficult or virtually impossible.

Advantageously a separate inner container of a plastic stable to approximately 100-105° C. with a melting point of approximately 130-150° C. is used. Thereby it is prevented that bitumen sticks to the container and subsequently cannot be detached from the container at the processing place. The inner container is due to its melting point meltable during the processing of the bitumen, whereby due to the small amount of material of the inner container in relation to the overall mass of the bitumen contained in the container no changes in the bitumen quality are to be expected.

In a preferred manner the stabilising means are provided in the lower half, preferably lower third, of the height of the container. Due to this measure a bulging can be prevented in a particularly effective way, as the stabilising means are mounted in just the region of the greatest bulging. The fabric forming the walls can further be stabilised by a coating, wherewith both the stretching ability and the deformation due to forces occurring obliquely to the warp and weft can be prevented in a particularly effective manner.

For easy loading on the one hand and for the hanging of the containers inside the freight container two corner welds lying next to each other of the walls can be connected by straps running roughly parallel to each other.

An embodiment of the invention is schematically shown in the drawing.

Figure 1:
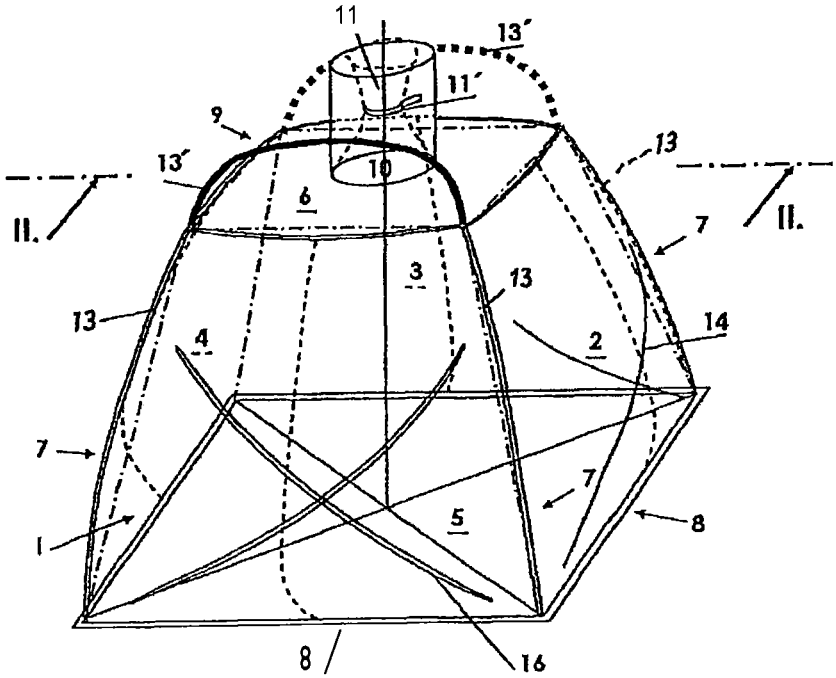
FIG. 1 shows a depiction of the container.

The container consists of a truncated cone formed by four trapezoidal lateral walls 1, 2, 3, 4, a floor 5 and a top surface 6, whereby the lateral walls 1, 2, 3, 4 are connected to each other by seams 7, the bottom edge of the lateral walls to the floor by seams 8 and the upper edge of the lateral walls with the top surface 6 by seams 9. The top surface 6 has a filling opening 10, through which the internal lining 11 protrudes, which is closable by a strip 11' or similar.

The inclination of the lateral walls to the floor (see FIG. 2, lateral wall 2 and floor 5) is, as indicated for angle $\alpha$, between 70° and 85°, preferably between 75° and 83°. As already mentioned, this leads to an optimisation of the filling volume on the one hand and a corresponding ability to straighten up by itself on the other hand, as when tilting of the container the floor 5 is lifted partially off the setting-up surface, whereby then due to the internal pressure of the filled in bitumen the lifted-off part of the floor is pressed down onto the setting-up surface, whereby due to the tensile rigid connection across the lateral walls (according to FIGS. 2, 4) and the top surface 6 the opposite lateral wall 2 is straightened up, such that a stable structure is achieved. Along the seams 7, 8, 9 the edges of neighbouring walls joining each other are beaded and in the upper part of the seams 7 the straps 13 are co-sewed, whereby a very strong stitching is effected. In the lower half in the lateral walls 1-4 the stabilising means 14 are inserted. These stabilising means can be sewn-in pleats, seams as well as sewn-in or weaved-in strips or the like. These stabilising means 14 run aslant from the corner areas upwards to the opposite corner seam 7, whereby in the present embodiment for each woven fabric two stabilising means 14 are envisaged crossing each other.

The straps 13 co-sewed along the side edges are formed as loop handles 13', wherein two loop handles running roughly parallel to each other are provided, and wherein the loop handles 13' can serve not only for the lifting via a forklift but as well for the fixation of the container inside of a standard container. This results, as mentioned earlier, in a stable, tensile rigid frame for interposed container walls.

Figure 2:
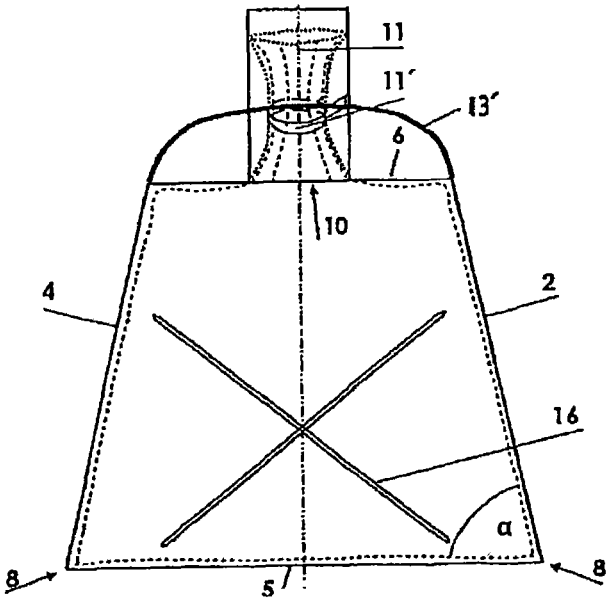
FIG. 2 is a section according to line II-II.

In FIG. 2 it is indicated, how the separate inner container 11 is introduced in the container, whereby it is essential that the inner container at least in the region of the seams 8 is connected with the walls of the container to prevent that an inwards folding or other deformation of the inner container results, which prevents that the container can be fully filled.

The present container is designed for liquid or viscous or creepable charges like bitumen, whereby it has been discovered, that due to the design the container has a high degree of self stabilisation.

The invention claimed is:

1. Large-volume packing container for bitumen, the container being made of flexible material and having a truncated pyramid-like basic shape prior to filling, wherein the container is closed at the top by a cover wall extending parallel to the bottom surface and having a preferably central filling opening, characterised in that in the temperature range from 100° to 110° C. the woven fabric forming the walls (1, 2, 3, 4, 5, 6) has a stretching capacity of 10-25%, preferably 15-20%, in the direction of the warp and weft, wherein stabilizing means (14), such as pleats, seams, strips or the like are drawn or sewn into the lower region of the fabric panels forming the lateral walls (1,2,3,4) in order to stabilize the woven fabric to forces occurring obliquely to the warp and weft, each one of said stabilizing means (14) being positioned to run aslant from a lower corner area of its respective wall upwards toward an opposite corner seam of the wall.

2. The packing container according to claim 1, wherein a separate inner container (11) of a plastic stable to approximately 100-105° C. with a melting point of approximately 130-150° C. is used.

3. The packing container according to claim 1, wherein the stabilising means (14) are provided in the lower half, preferably lower third, of the height of the container.

4. The packing container according to claim 1, wherein the fabric forming the walls (1, 2, 3, 4, 5, 6) is stabilised by a coating.

5. The packing container according to claim 1, wherein two corner welds (7) lying next to each other of the lateral walls (1, 2, 3, 4) are connected by straps (13') running roughly parallel to each other.

6. The packing container according to claim 2, wherein the stabilizing means (14) are provided in the lower half, preferably lower third, of the height of the container.

7. The packing container according claim 2, wherein the fabric forming the walls (1, 2, 3, 4, 5, 6) is stabilized by a coating.

8. The packing container according to claim 3, wherein the fabric forming the walls (1, 2, 3, 4, 5, 6) is stabilized by a coating.

9. The packing container according to claim 2, wherein two corner welds (7) lying next to each other of the lateral walls (1, 2, 3, 4) are connected by straps (13') running roughly parallel to each other.

10. The packing container according to claim 3, wherein two corner welds (7) lying next to each other of the lateral walls (1, 2, 3, 4) are connected by straps (13') running roughly parallel to each other.

11. The packing container according to claim 4, wherein two corner welds (7) lying next to each other of the lateral walls (1, 2, 3, 4) are connected by straps (13') running roughly parallel to each other.

12. The packing container according to claim 1, wherein at least one of said lateral walls (1,2,3,4) has two of said stabilizing means (14) drawn or sewn into the lateral wall, and said two stabilizing means (14) cross each other.

* * * * *